United States Patent [19]

Hashizume

[11] Patent Number: 4,909,229

[45] Date of Patent: Mar. 20, 1990

[54] IGNITION SYSTEM FOR AN INTERNAL COMBUSTION ENGINE

[75] Inventor: Atsushi Hashizume, Hyogo, Japan

[73] Assignee: Mitsubishi Denki Kabushiki Kaisha, Tokyo, Japan

[21] Appl. No.: 259,665

[22] Filed: Oct. 19, 1988

[30] Foreign Application Priority Data

Oct. 19, 1987 [JP] Japan ..... 62-264165

[51] Int. Cl.[4] ..... F02P 1/08; F02B 77/00

[52] U.S. Cl. ..... 123/631; 123/630

[58] Field of Search ..... 123/631, 630

[56] References Cited

U.S. PATENT DOCUMENTS

| | | | |
|---|---|---|---|
| Re. 15,408 | 7/1922 | Kennington | 123/631 |
| 4,080,940 | 3/1978 | Fuzzell et al. | 123/631 |
| 4,388,900 | 6/1983 | Horbi | 123/631 |
| 4,491,122 | 1/1985 | Pitco | 123/631 |

*Primary Examiner*—Raymond A. Nelli

*Attorney, Agent, or Firm*—Sughrue, Mion, Zinn, Macpeak & Seas

[57] ABSTRACT

An ignition system for an internal combustion engine for preventing the generating of ignition sparks when the engine is reversely rotated, wherein an ignition coil for energizing a spark plug is slowly deenergized when the engine is in reverse rotation, whereby engine damage is avoided.

4 Claims, 4 Drawing Sheets

IGNITION SYSTEM FOR AN INTERNAL COMBUSTION ENGINE

FIELD OF THE INVENTION

This invention relates to an ignition system for an internal combustion engine arranged to prevent the generation of ignition sparks when the engine is in reverse rotation.

DESCRIPTION OF THE PRIOR ART

A typical conventional ignition system for an internal combustion engine is shown in the circuit diagram of FIG. 1 in which a sensor means 1 is provided for detecting angular positions of the internal combustion engine (not shown). The sensor 1 operates in synchronism with the engine to generate an output which falls from high level to low level at a first angular position $\theta_1$ of the engine and rises from low level to high level at a second angular position $\theta_2$. The output is maintained at the low level (first state) during the operation of the engine from the first angular position $\theta_1$ to the second angular position $\theta_2$ and is maintained at high level (second state) in the remaining period of operation of the engine.

The conventional system of FIG. 1 is further provided with a transistor 2 adapted to receive at its base the output from the sensor means 1, the emitter of the transistor 2 being grounded or connected to a negative or (−) terminal of a battery 3 and the collector of the transistor 2 being connected through a resistor 4 to a positive or (+) terminal of the battery 3.

A transistor 5 is also provided which is adapted to receive at its base the output from the collector of the transistor 2, the emitter of the transistor 5 being grounded and the collector thereof being connected through the primary winding of an ignition coil 6 to the (+) terminal of the battery 3. Also connected between the secondary winding of the ignition coil 6 and the ground is an ignition plug 7.

FIG. 2 shows waveforms and assists in explaining the operation of the system of FIG. 1, and the waveforms a–d shown in FIGS. 2(*a*)–(*d*) correspond to the signals appearing at points a–d, respectively, shown in FIG. 1. In other words, FIG. 2(*a*) shows the output voltage of the sensor means 1, FIG. 2(*b*) the collector voltage of the transistor 2, FIG. 2(*c*) the collector voltage of the transistor 5 and FIG. 2(*d*) the secondary output voltage of the ignition coil 6.

The operation of the above-described conventional system is described below. Referring to FIGS. 1 and 2, the first angular position $\theta_1$ of the engine is detected at a time $t_1$ so that the output of the sensor means 1 is turned from high level to low level, as shown in FIG. 2(*a*), thereby switching the transistor 2 from its on-state to its off-state.

Accordingly, the transistor 5 is turned on and current flows through the primary winding of the ignition coil 6.

When the second angular position $\theta_2$ of the engine is detected at a subsequent time $t_2$, the output of the sensor means 1 is switched from low level to high level so that the transistor 2 is switched from the off-state to the on-state. Thus, the collector voltage b thereof is switched to low level as shown in FIG. 2(*b*), and the transistor 5 is turned off to change the collector voltage c as shown in FIG. 2(*c*) and thereby interrupt the current flowing through the primary winding of the ignition coil 6 and generate a secondary high voltage output or secondary output voltage d across the secondary winding of the ignition coil 6, as shown in FIG. 2(*d*), hence causing an ignition spark to be generated at the ignition plug 7.

Similarly, at subsequent times $t_3$ and $t_4$, current starts to flow through the primary winding of the ignition coil 6 at the first angular position $\theta_1$ and an ignition spark is generated at the second angular position $\theta_2$.

At a time $t_5$, current similarly flows through the primary winding of the ignition coil 6 at and after the first angular position $\theta_1$.

However, if the engine thereafter rotates in the opposite direction (hereinunder referred to as reverse rotation), i.e., opposite to the direction in which the engine has just rotated (hereinunder referred to as normal rotation) at a time $t_6$ before the engine reaches the second angular position $\theta_2$, the engine will pass through the first angular position $\theta_1$ during the reverse rotation at a time $t_7$.

This may result from the fact that the second angular position $\theta_2$ is near the top dead center of the compression stroke of the engine and, as the engine is operated in the normal rotation from the first angular position $\theta_1$ to the second angular position $\theta_2$, the compression pressure is increased to such an extent that the engine cannot pass over the top dead center and ultimately the engine is rotated in the reverse direction to return towards the bottom dead center in the case where the driving force is insufficient.

Since the engine passes through the first angular position $\theta_1$ during the reverse rotation at the time $t_7$, the output of the sensor means 1 is switched at that time from low level to high level. This operation is quite reverse to the aforementioned operation at the time $t_5$ in which the engine passes through the first angular position $\theta_1$ in the normal rotation to turn the output of the sensor means 1 from high level to low level.

Since the output of the sensor means 1 turns to high level at the time $t_7$, the transistor 2 is switched to the on-state and the transistor 5 is hence turned off.

Thus, the current flowing through the primary winding of the ignition coil 6 is interrupted at the time $t_7$ to generate an ignition spark at the ignition plug 7 as shown in FIG. 2(*d*), thereby further promoting the reverse rotation of the engine. This may lead to engine damage.

SUMMARY OF THE INVENTION

The object of the present invention is to solve the problems existing in the above-described prior art and to provide an improved ignition system for an internal combustion engine which can prevent the generation of any ignition sparks when the engine is in reverse rotation, thereby avoiding any possibility of engine damage and ensuring safe operation of the engine.

According to the present invention, there is provided an ignition system for an internal combustion engine comprising a voltage generating means for generating voltage when the engine is in reverse rotation, a comparing means for comparing the voltage generated by said voltage generating means with a predetermined voltage, and an ignition preventing means operable in response to said comparing means to cut off any secondary output from an ignition coil which would otherwise generate an ignition spark.

With this arrangement, the voltage generated by the voltage generating means when the engine is in the reverse rotation is compared by the comparing means with the predetermined voltage, and if the voltage of the voltage generating means is lower than the predetermined voltage the generation of ignition sparks is prevented by the ignition preventing means.

DETAILED DESCRIPTION OF THE PREFERRED EMBODIMENT

Figure 1:
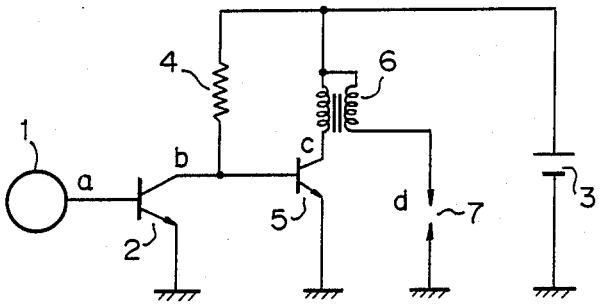
Fig. 1 (PRIOR ART)
FIG. 1 is a circuit diagram of a conventional ignition system for an internal combustion engine.
Figure 2:
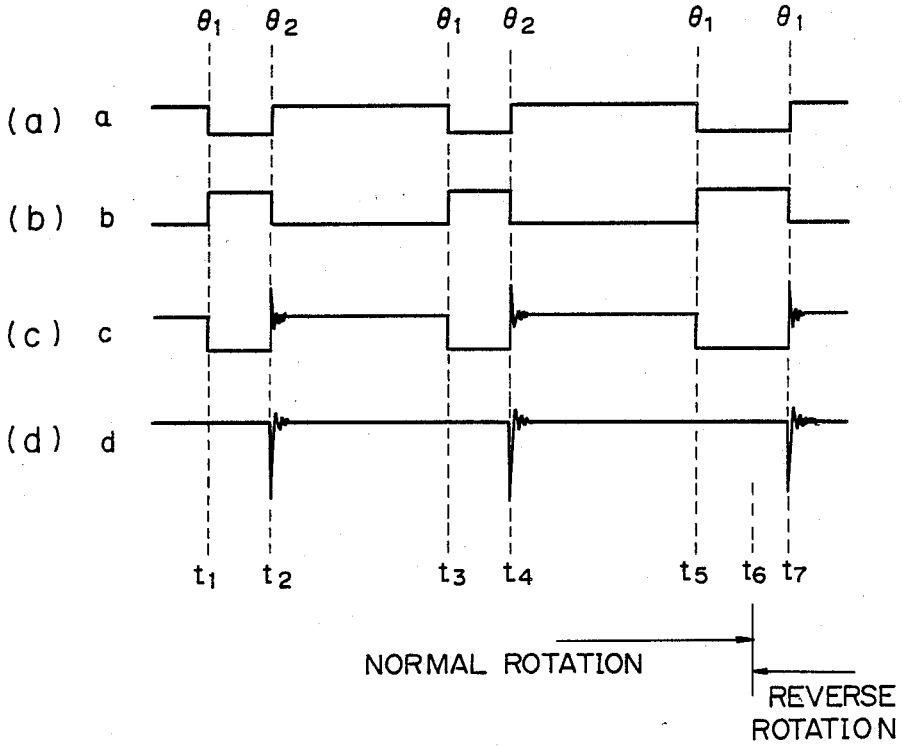
Fig. 2 (PRIOR ART)
FIG. 2 shows waveforms of signals at various points of the conventional system of FIG. 1 and assists in explaining the operation thereof.

A preferred embodiment of the present invention will now be described. Those portions of the structure shown in FIG. 3 which are similar to those of the structure shown in FIG. 1 are referred to by the same reference numerals to avoid redundant description of similar portions.

Figure 3:
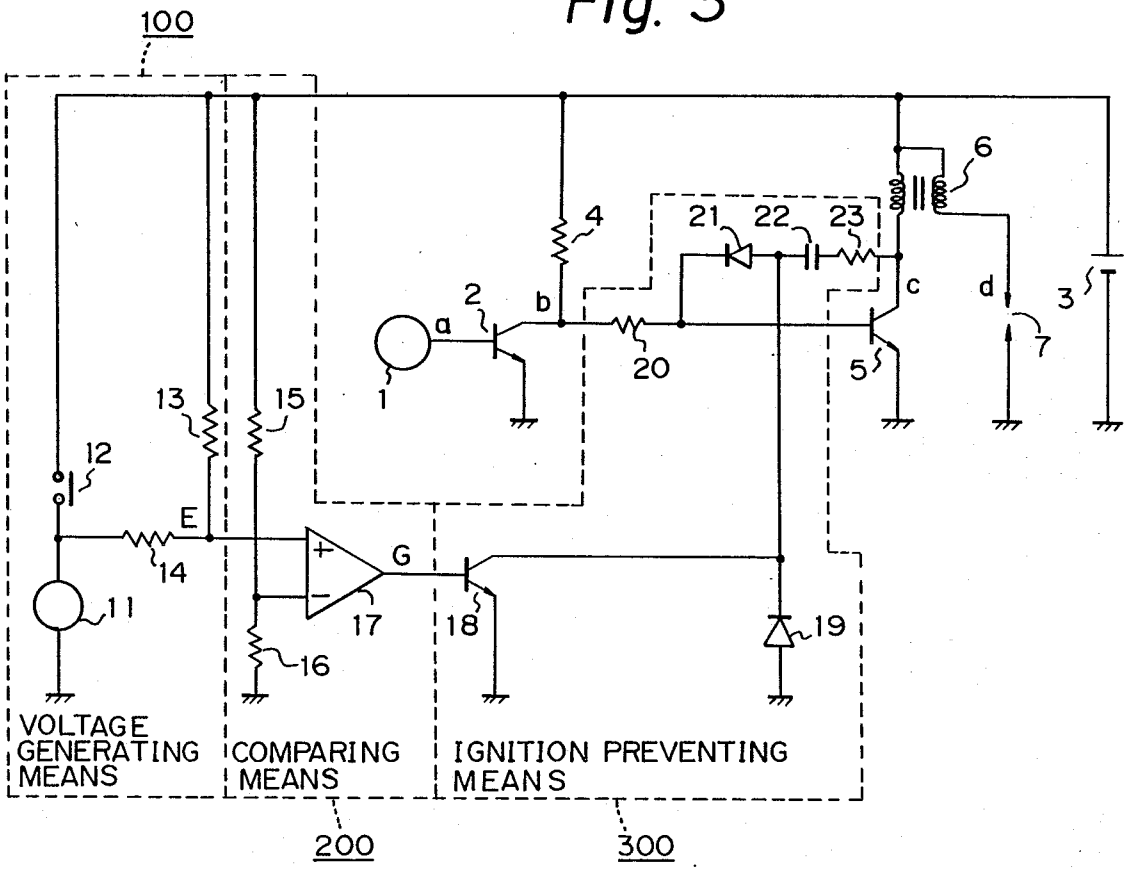
FIG. 3 is a circuit diagram of a preferred embodiment of an ignition system for an internal combustion engine in accordance with the present invention.

As will be apparent in comparing FIG. 3 with FIG. 1, the portions referred to by the numerals 1 to 7 in FIG. 3 are the same as those in FIG. 1, and the portions referred to by numbers higher than 11 are additional to what is shown in FIG. 3 and constitute novel and improved portions of the embodiment of FIG. 3.

The system of FIG. 3 is provided with a starter 11 for starting the operation of the engine (not shown). The starter 11 is connected at one end to the (+) terminal of the battery 3 through a switch 12 and the other end of the starter 11 is grounded. The starter 11 is energized and deenergized in response to the on-off operation of the switch 12.

A resistor 13 is connected between the (+) terminal of the battery 3 and a (+) input terminal of a comparator 17, and a resistor 14 is also connected between the (+) input terminal of the comparator 17 and a junction between the starter 11 and the switch 12.

The starter 11, the switch 12 and the resistors 13, 14 constitute a voltage generating means 100 for generating a certain level of voltage when the engine is in reverse rotation.

Resistors 15 and 16 are connected in series between the (+) terminal of the battery 3 and the ground to generate a predetermined voltage at a junction between the resistors 15 and 16 and this predetermined voltage is applied to a (−) input terminal of the comparator 17.

The comparator 17 is adapted to compare the voltage generated in the means 100 with said predetermined voltage and to generate an output based thereon. The comparator 17 and the resistors 15, 16 constitute a comparing means 200.

Also provided is a transistor 18 the emitter of which is grounded and the base of which is supplied with the output of the comparator 17. The transistor 18 is adapted to turn on or off in response to the output of the comparator 17. The collector of the transistor 18 is connected to the cathode of a diode 19.

The anode of the diode 19 is grounded and the cathode thereof is connected to a junction between a diode 21 and a capacitor 22.

In addition, a resistor 20 is connected between the collector of the transistor 2 and the base of the transistor 5, and interposed between the collector and base of the transistor 5 is a series circuit constituted by a resistor 23, the capacitor 22 and the diode 21.

The circuit path through the collector of the transistor 5, the resistor 23, the capacitor 22, the diode 21 and the base of the transistor 5 constitutes a negative feedback circuit.

The junction between the anode of the diode 21 and the capacitor 22 is connected to the collector of the transistor 18 to control the completion or interruption of said negative feedback circuit in response to the transistor 18 being in the on or off state.

The transistor 18, the diodes 19, 21, the resistors 20, 23 and the capacitor 22 constitute an ignition preventing means 300.

Figure 4:
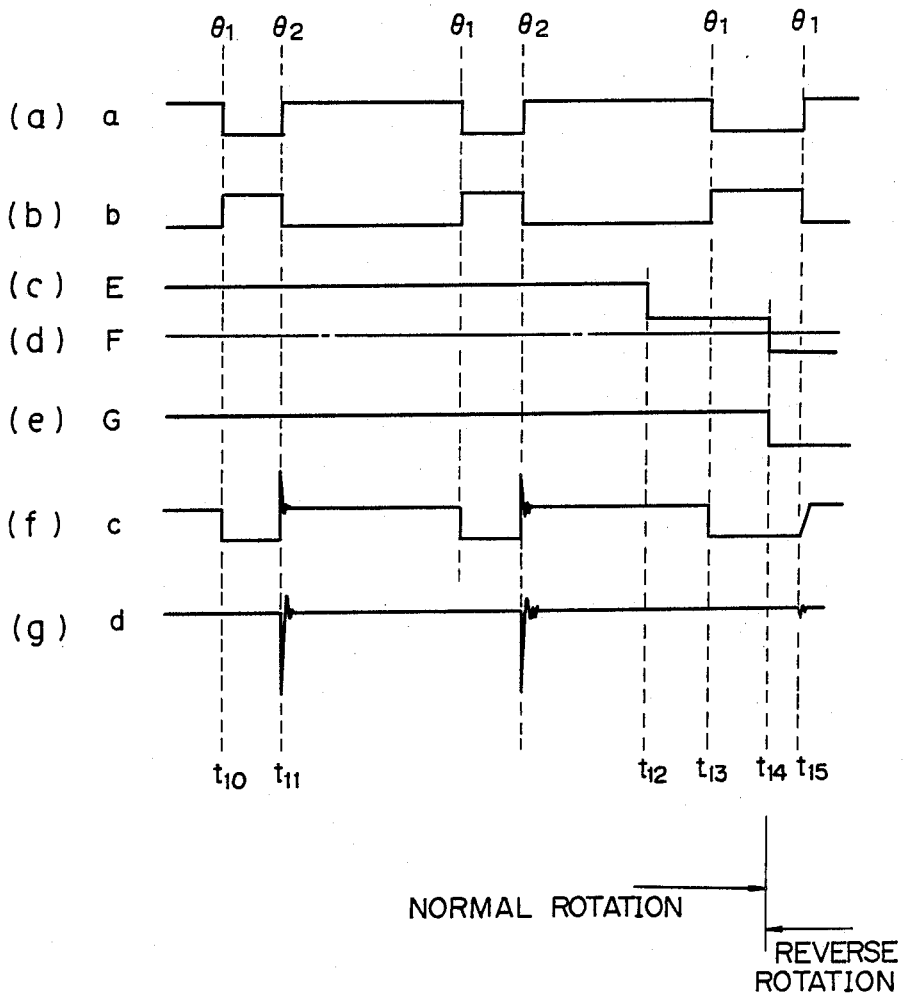
FIGS. 4 and 5 show waveforms of signals at various points of the embodiment of FIG. 3.

FIG. 4 shows waveforms of various signals and illustrates the operation of the system of FIG. 3. The signal a of FIG. 4(*a*) is an output signal of the sensor means 1, the signal b of FIG. 4(*b*) is a signal appearing at the collector of the transistor 2, the signal E of FIG. 4(*c*) is a signal at the (+) input terminal of the comparator 17, the signal F of FIG. 4(*d*) is a voltage at the (−) input terminal of the comparator 17, the signal G of FIG. 4(*e*) is an output voltage of the comparator 17, the signal c of FIG. 4(*f*) is a signal appearing at the collector of the transistor 5 and the signal d of FIG. 4(*g*) is an ignition spark at the ignition plug 7.

The operation will now be described. In FIGS. 3 and 4, at a time $t_{10}$, when the sensor means 1 detects the first angular position $\theta_1$, the transistor 2 is turned off so that its collector signal is varied as shown in FIG. 4(*b*). Due to this, the current flowing through the resistor 4 is directed through the resistor 20 to the base of the transistor 5.

Since the diode 21 is disposed in the backward direction, no current flows through the negative feedback circuit including the diode 21 and thus the current flowing through the resistor 4 is directed through the resistor 20 to the base of the transistor 5 so that the transistor is turned on and the collector current flows as shown in FIG. 4(*f*) to allow flow of current through the primary winding of the ignition coil 6.

Simultaneously, a discharge current flows through the capacitor 22 along a discharge path constituted by the ground, the diode 19, the capacitor 22, the resistor 23, the collector of the transistor 5 and the emitter of the transistor 5, but this current does not affect the on-state of the transistor 5.

When the sensor means 1 then detects the second angular position $\theta_2$ at a time $t_{11}$, the transistor 2 is turned on and the current flowing through the resistor 4 is directed to the collector of the transistor 2 to interrupt the base current from the resistor 4 to the transistor 5.

Before the time $t_{12}$, the switch 12 is closed and the voltage of the battery 3 is applied to the terminal of the starter 11. Therefore, the voltage E is higher than the voltage F and the output G of the comparator 17 is at high level as shown in FIG. 4(*e*), the transistor 18 being in the on-state.

Thus, the charging current to the capacitor 22 when the collector potential of the transistor 5 was raised at the time $t_{11}$ flows through the resistor 23, the capacitor 22 and the collector of the transistor 18 to the emitter of the latter and does not affect the on-state of the transistor 5.

At the time $t_{11}$, therefore, the primary current of the ignition coil 6 is interrupted to generate an ignition spark at the ignition plug 7 as shown in FIG. 4(*g*).

At the time $t_{12}$, the switch 12 opens and the terminal voltage of the starter 11 decreases to the ground potential and the voltage E [FIG. 4(*c*)] is also reduced. However, the resistances of the resistors 13–16 are set to hold the voltage E at a value higher than that of the voltage F during the period from the time $t_{12}$ to a time $t_{14}$.

At a time $t_{13}$, the sensor means 1 detects the first angular position $\theta_1$ and current flows through the primary winding of the ignition coil 6 (in the same manner as at the time $t_{10}$).

After the time $t_{13}$ and before the sensor means 1 detects the second angular position $\theta_2$, the reverse rotation begins to occur at $t_{14}$ and the engine rotates reversely. Thus, the rotor of the starter 11 is rotated in the direction opposite to the normal direction thereof so that a negative voltage is generated at the terminal of the starter 11 according to the principle of a generator.

Consequently, the voltage E is also reduced and at this time the voltage E first becomes lower than the voltage F [FIG. 4(*d*)].

Accordingly, the voltage at the (+) input terminal of the comparator 17 also becomes lower than that at the (−) input terminal so that the output G of the comparator 17 drops to low level as seen in FIG. 4(*e*), and the transistor 18 is turned off at the time $t_{14}$.

Consequently, at a time $t_{15}$ and when the sensor means 1 detects the first angular position while the engine is rotating reversely, the transistor 2 turns on, and when the transistor 5 is about to turn off, the charging current for the capacitor 22 flows through the path constituted by (+) terminal of the battery 3, the primary winding of the coil 6, the resistor 23, the capacitor 22, the diode 21, the base of the transistor 5 and the emitter of the latter, and this charging current becomes the base current of the transistor 5, acting to turn on the latter.

Once the transistor 5 has completely turned on, no flow of said charging current takes place and thus the transistor 5 slowly turns from the on-state to the off-state while maintaining a certain balance, this being achieved by appropriately selecting the time constant of the charging.

When the capacitor 22 has fully been charged, the flow of charging current to the capacitor 22 becomes null and the transistor 5 is completely turned off.

Since the transistor 5 slowly turns from the on-state to the off-state at the time $t_{15}$, the primary current of the ignition coil 6 is also interrupted at a slow speed, and thus the output voltage of the secondary winding of the ignition coil 6 becomes too low to generate an ignition spark at the ignition plug 7.

The example in which reverse rotation occurs after the sensor means detects the first angular position $\theta_1$ at the time $t_{13}$ and before the engine reaches the second angular position $\theta_2$ has been described by reference to FIG. 4, but the circuit of FIG. 3 would also be effective in a case where the reverse rotation occurs before detecting the first angular position $\theta_1$. Such a case is illustrated by waveforms in FIG. 5. The waveforms of FIGS. 5(*a*)–5(*g*) correspond to those of FIGS. 4(*a*)–4(*g*).

Figure 5:
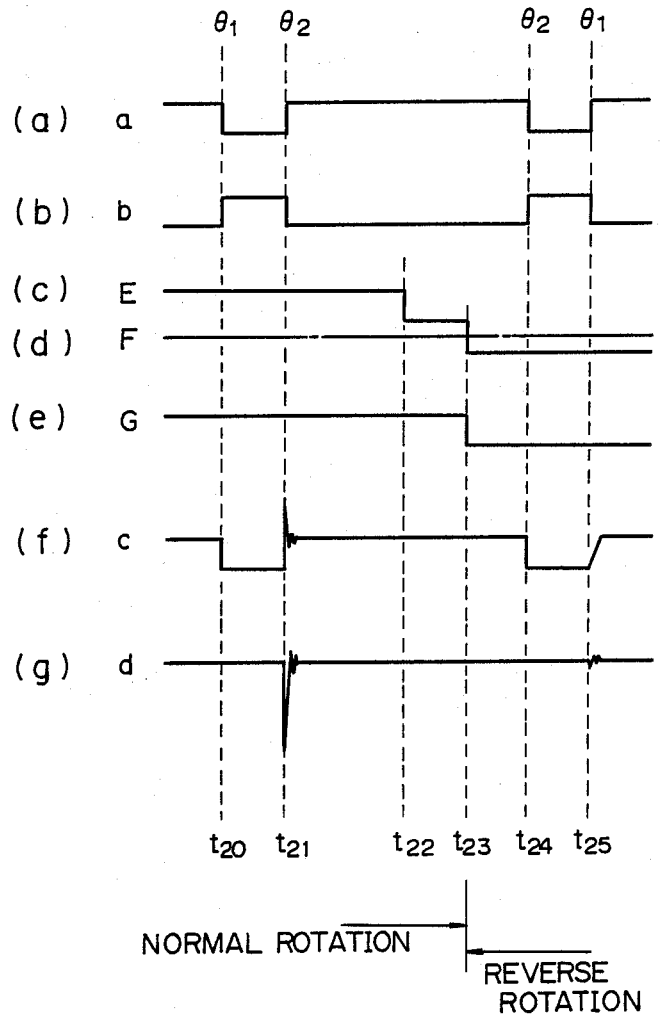

In FIG. 5, the first angular position $\theta_1$ is detected by the sensor means 1 at a time $t_{20}$ to allow the flow of current through the primary winding of the ignition coil 6, and the second angular position $\theta_2$ is detected at a time $t_{21}$ to cause an ignition spark at the ignition plug 7.

Thereafter the switch 12 opens at a time $t_{22}$ and if it is assumed that the reverse rotation occurs at a time $t_{23}$ before the engine reaches the first angular position $\theta_1$, the second angular position $\theta_2$ is detected in the reverse rotation at a time $t_{24}$, and the output of the sensor means 1 is turned from high level to low level. Thus, current flows through the primary winding of the ignition coil 6, and at a subsequent time $t_{25}$ the first angular position $\theta_1$ is detected in the reverse rotation to turn the output of the sensor means 1 from the low level to the high level. Thus the transistor 5 is slowly turned from the on-state to the off-state and no ignition spark is generated at the ignition plug 7, as seen in FIG. 5(*g*).

Although the above-described embodiment uses the comparator 17 to compare the terminal voltage of the starter 11 with the predetermined voltage, it is possible to use base-emitter voltage of a transistor as a threshold value, and the invention should not be limited to systems which generate negative voltage when the engine is in reverse rotation.

As described above, the present invention is arranged such that a voltage is generated in a voltage generating means at a time of reverse rotation of the engine and this voltage is compared by a comparing means with a predetermined voltage to allow suppression of the generation of ignition sparks by an ignition preventing means in response to the result of the comparison, and with this arrangement there an ignition system can be provided which is safe to operate and in which no risk of damage engine is present when the engine experiences reverse rotation.

What is claimed is:

1. An ignition system for an internal combustion engine, comprising:

sensor means having an output which takes a first state at a first angular position of the engine and a second, different state at a second angular position of the engine;

a transistor for alternately allowing and interrupting the flow of current through a primary winding of an ignition coil in response to the output of said sensor means;

voltage generating means for generating a first voltage response to a forward rotation of the engine and a second, different voltage in response to a reverse rotation of the engine;

comparing means for comparing an output of said voltage generating means with a predetermined voltage to produce a comparison output; and ignition preventing means for inhibiting the generation of ignition sparks at the time of a secondary output of said ignition coil in response to said second voltage while permitting the generation of ignition sparks in response to said first voltage, wherein, during reverse rotation of said engine, said ignition preventing means maintains a state of conduction of said transistor for a time sufficient to inhibit the generation of ignition sparks.

2. An ignition system for an internal combustion engine as set forth in claim 1, wherein the interruption of said flow of current by said transistor is performed at a slow speed, whereby the secondary output voltage of said ignition coil is suppressed.

3. An ignition system for an internal combustion engine as set forth in claim 1, wherein said voltage generating means includes a starter for generating a negative voltage during the reverse rotation of the engine and a circuit for achieving a level change of said negative voltage with a resistor.

4. An ignition system as set forth in claim 1, wherein said ignition preventing means comprises a feedback circuit, including a capacitor, connected between a collector and a base of said transistor.

* * * * *